219-121 316 SR
1/7/86 XR 4,563,228

United States Patent [19]
Lüders et al.

[11] Patent Number: 4,563,228
[45] Date of Patent: Jan. 7, 1986

[54] METHOD AND APPARATUS FOR REGULATING THE PERMEABILITY OF WRAPPING MATERIAL FOR ROD-SHAPED SMOKERS PRODUCTS

[75] Inventors: Elke Lüders, Strohdeich; Kurt-Eckhard Petersen, Wentorf, both of Fed. Rep. of Germany

[73] Assignee: Hauni-Werke Körber & Co. KG, Hamburg, Fed. Rep. of Germany

[21] Appl. No.: 864,441

[22] Filed: Dec. 27, 1977

[30] Foreign Application Priority Data

Dec. 29, 1976 [LU] Luxembourg ..... 76490

[51] Int. Cl.[4] ..... B32B 31/12

[52] U.S. Cl. ..... 156/64; 83/30; 83/73; 83/365; 131/281; 156/252; 156/353; 156/378; 156/379; 156/513; 219/121 LL; 219/384; 428/131; 493/10

[58] Field of Search ..... 73/499, DIG. 11; 83/30, 83/72, 73, 74, 365, 520; 93/1 C, 77 FT; 131/21 R, 23 R, 15 B, 88, 170 R, 198 R, 254; 156/64, 252, 256, 353, 360, 367, 378, 379, 513; 428/131; 219/121 LL, 384; 493/10

[56] References Cited

U.S. PATENT DOCUMENTS

| | | | |
|---|---|---|---|
| 2,994,783 | 8/1961 | Looschen | 83/365 X |
| 3,167,641 | 1/1965 | Parmele et al. | 131/15 B X |
| 3,283,636 | 11/1966 | Huck | 83/365 |
| 3,351,740 | 11/1967 | Heuer | 83/365 X |
| 3,622,751 | 11/1971 | Larive et al. | 83/365 X |
| 4,046,614 | 9/1977 | Zahn et al. | 156/378 X |
| 4,090,826 | 5/1978 | Hinzmann | 131/170 R X |

OTHER PUBLICATIONS

*Chemical Engineers' Handbook*, Perry & Chilton, Fifth Edition, McGraw-Hill Book Company, 1973, pp. 22-4 and 22-5.

*Marks' Mechanical Engineers' Handbook*, T. Baumeister Sixth Edition, McGraw-Hill Book Company, 1958, pp 16-31 to 16-33 and 16-49.

*Primary Examiner*—Robert A. Dawson
*Attorney, Agent, or Firm*—Peter K. Kontler

[57] ABSTRACT

A continuous web which is drawn off a roll is perforated on its way toward the wrapping station of a machine for the making of plain or filter tipped smokers products or filter rod sections. The perforating device is adjustable by a control system which receives signals from a photoelectronic testing unit serving to monitor the permeability of successive increments of the web between the perforating device and the wrapping station. The combined cross-sectional area of holes per unit area of the web is increased or reduced, depending upon whether the monitored permeability is less than or exceeds a preselected optimum permeability.

15 Claims, 1 Drawing Figure

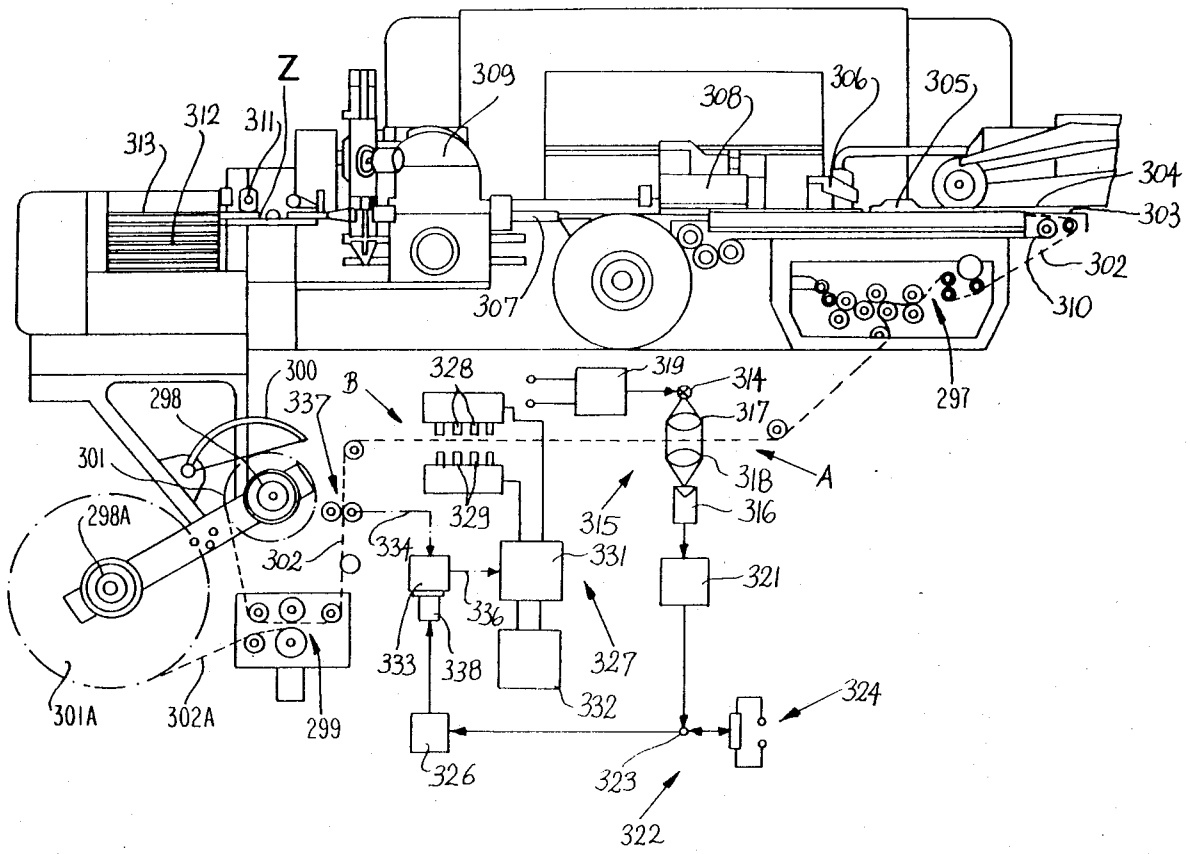
304
303
302
310
305
297
306
308
309
307
A
314
317
318
316
321
324
319
315
331
327
332
323
322
328
329
336
338
326
334
333
B
337
300
302
299
Z
311
312
313
298
298A
301
302A
301A

METHOD AND APPARATUS FOR REGULATING THE PERMEABILITY OF WRAPPING MATERIAL FOR ROD-SHAPED SMOKERS PRODUCTS

CROSS-REFERENCE TO RELATED APPLICATION

The method and apparatus of the present invention constitute modifications of the method and apparatus disclosed in the commonly owned copending application Ser. No. 841,108 filed Oct. 11, 1977 by Günter Wahle et al, now U.S. Pat. No. 4,193,409.

BACKGROUND OF THE INVENTION

The present invention relates to a method and apparatus for regulating the permeability of wrapping material for rod-shaped articles which constitute or form part of smokers' products. More particularly, the invention relates to a method and apparatus for regulating and maintaining at a desired level the rate of admission of cool atmospheric air into the column of tobacco smoke in a region which is preferably close to one end of a rod-shaped smokers' product, such as a plain or filter-tipped cigarette, cigar or cigarillo. Still more particularly, the invention relates to a method and apparatus for regulating the permeability of wrapping material for rod-shaped smOkers' products in a manner such as to insure that the permeability of the wrapper of each and every product which leaves the maker (or at least the great majority of the products) will exhibit an optimum permeability.

Rod-shaped smokers' products having wrappers with so-called climatic zones (i.e., with zones which are perforated in order to permit entry of cool atmospheric air into the column of tobacco smoke) are becoming increasingly popular. In fact, many manufacturers of cigarettes or the like demand that each machine for the making of plain or filter tipped cigarettes or analogous smokers' products be equipped with apparatus which serve to perforate selected portions of the wrappers, preferably in a region close to one or both ends of a plain cigarette or in a region close to (and including) the mouthpiece of a filter-tipped rod-shaped smokers' product. The admission of cool atmospheric air into the column of tobacco smoke influences the percentage of nicotine and condensates. In addition, the admitted atmospheric air reduces the temperature of the smoke column.

The aforementioned commonly owned U.S. Patent of Wahle et al. discloses a method and apparatus for automatically regulating the permeability of wrapping material for rod-shaped smokers' products by testing the finished or partly finished rod-shaped articles for permeability of their tubular wrappers and by regulating the operation of perforating means in dependency on the results of testing. The perforating means may include needles, punching tools, one or more spark generators, one or more lasers or a combination of these. The perforating means can be placed adjacent the path of a continuous rod which is to be subdivided into discrete rod-shaped articles, adjacent the path of discrete rod-shaped articles, or adjacent the path of the web which travels toward the wrapping station. The regulating step includes comparing signals which are furnished by the testing unit with a reference signal and adjusting the perforating means when the intensity or another characteristic of test signals deviates from the same characteristic of the reference signal.

The testing unit is located downstream of the wrapping station or stations, i.e., at a location which is remote from the perforating means, especially if the perforating means is adjacent the path of the web which is about to be draped around one or more rod-like fillers. Consequently, if the permeability of the wrappers forming part of articles which arrive at the testing station is unsatisfactory, a substantial number of articles will have to be discarded in order to prevent their entry into storage or into a packing machine. For example, if the perforating means is adjacent the path along which the web of cigarette paper moves from a source to the wrapping station of a cigarette maker, and if cigarettes which are produced by the maker are thereupon admitted into a filter cigarette making machine which assembles plain cigarettes with filter plugs to form filter cigarettes, the testing unit is normally adjacent the path of filter cigarettes. Therefore, when the testing unit detects the presence of filter cigarettes whose wrappers are defective because the permeability of their material is excessive or insufficient, the entire series of plain cigarettes and filter cigarettes between the loci of the perforating means and testing unit is defective. Furthermore, certain makers of rod-shaped articles which form part of smokers' products are not invariably equipped with testing units. Typical examples of such makers are machines for the production of filter rods; the rods are severed to yield filter rod sections of desired length and the sections are introduced into a machine for the production of filter cigarettes, cigars or cigarillos. Thus, a very long series of filter rod sections can comprise wrappers whose porosity is unsatisfactory, and the defects will be detected only subsequent to admission into the next machine, e.g., into a filter cigarette maker. This can result in the production of extremely large numbers of defective smokers' products, especially in modern high-speed production lines which are designed to turn out up to and in excess of 70 smokers' products per second.

OBJECTS AND SUMMARY OF THE INVENTION

An object of the invention is to provide a novel and improved method of regulating the permeability of wrappers of rod-shaped articles which constitute or form part of smokers' products in such a way that the number of defective products is reduced to a small fraction of the number of defective products which are turned out by machines wherein the permeability is regulated in accordance with heretofore known methods.

Another object of the invention is to provide a method of the just outlined character which invariably insures that the number of defective articles or the number of defective constituents of such articles between the perforating and testing stations is a small fraction of the number of defective articles or constituents between the perforating and testing stations of apparatus which are used for the practice of conventional methods.

A further object of the invention is to provide a novel and improved apparatus for regulating the permeability of wrapping material for rod-shaped articles which constitute or form part of smokers' products.

Another object of the invention is to provide an apparatus adapted to insure satisfactory permeability of wrapping material in machines which are not or need not be equipped with testing units of the type customarily employed in machines for the production of filter cigarettes, cigars or cigarillos.

An additional object of the invention is to provide an apparatus which can be readily installed in existing machines for the manufacture of rod-shaped articles which constitute or form part of smokers' products, such as makers of plain cigarettes or filter rod sections.

A further object of the invention is to provide a maker of plain cigarettes or the like which embodies the above outlined apparatus.

One feature of the invention resides in the provision of a method of regulating the permeability of a web of wrapping material (such as cigarette paper, artificial cork or reconstituted tobacco) which is converted into tubular wrappers surrounding the fillers of rod-shaped articles constituting or forming part of smokers' products (the products may constitute plain or filter tipped cigarettes, cigars or cigarillos or simple or multiplex filter rod sections). The method comprises the steps of advancing the web and the fillers to a wrapping station (the web can be withdrawn from a roll or another suitable source of supply, and the fillers may constitute coherent parts of a continuous rod-like filler consisting of tobacco and/or filter material), draping the web around the fillers at the wrapping station, making holes in the material of the web, monitoring the permeability of the web ahead of the wrapping station, comparing the monitored permeability with a predetermined value which denotes the desired or optimum permeability of the web, and changing the combined cross-sectional area of holes per unit area of the material of the web when the monitored permeability deviates from the predetermined value. If the holes have identical diameters, the last mentioned step includes changing the number of holes per unit area of the material of the web. If the instrumentalities which are used to make holes are of such nature that they can change the size of holes, the step of changing the combined cross-sectional area of holes per unit area of the web can include changing the number and/or size of holes.

The step of making holes may but need not precede the monitoring step. For example, the holes can be made immediately or shortly after successive increments of the web leave the source of wrapping material, and the testing station where the monitoring of permeability takes place can closely follow the hole making instrumentalities, as considered in the direction of movement of the web toward the wrapping station. Alternatively, the hole making instrumentalities can be installed downstream of the wrapping station, i.e., the holes can be made in the tubular wrapper for the fillers or subsequent to subdivision of the tubular wrapper into the wrappers of individual rod-shaped articles. The first mentioned procedure is preferred at this time because it insures that web portions whose permeability is unsatisfactory can be detected in close proximity of the hole making instrumentalities, i.e., the number of defective articles can be reduced to a minimum. However, the monitoring step can serve a useful purpose even if the hole making instrumentalities are located downstream of the testing or monitoring station because, as a rule, the material of the web is at least slightly porous and the monitoring step can detect deviations from standard porosity whereby a regulation of the hole making step compensates for deviations of initial porosity from expected porosity.

The step of making holes may include removing portions of the material of the web, e.g., by burning holes into such material.

The monitoring step may include directing a beam of light against one side of the web and monitoring the quantity of light which passes through successive increments of the web. The quantity of light which passes through the web is indicative of permeability of the respective increments.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single Figure is a fragmentary partly elevational and partly schematic view of a cigarette making machine provided with an apparatus which embodies one form of the invention.

DESCRIPTION OF THE PREFERRED EMBODIMENTS

The drawing shows a portion of a cigarette making machine of the type known as GARANT produced by Hauni-Werke Körber & Co. KG, Hamburg, Federal Republic Germany. Those features which are not essential for the understanding of our invention have been omitted for the sake of clarity. A complete cigarette maker of the class shown in the drawing is illustrated, for example, in commonly owned U.S. Pat. No. 4,025,770 granted to Reuland on May 24, 1977. The construction of the illustrated machine, as well as of that shown in the patent to Reuland, is similar to the construction of a filter rod making machine; the sole important difference is that, in a cigarette maker, a web of wrapping material is draped around a rod-like filler which consists of natural, reconstituted and/or artificial tobacco whereas the web of wrapping material which is caused to travel through a filter rod maker must be draped around a continuous tow of filamentary filter material or around a continuous or interrupted rod-like filler consisting of two or more different types of filter material. It is further clear that the machine which is shown in the drawing can be used with equal advantage for the production of cigars or cigarillos.

Referring to the drawing in detail, a source/supply of convoluted wrapping material (cigarette paper web 302) is stored on a spindle 298 and forms a roll 301. The diameter of the roll 301 is monitored by a suitable detector 300 which transmits a signal when the diameter is reduced to a predetermined minimum value (i.e., when the supply 301 is nearly exhausted). The signal actuates a splicing device 299 of any suitable design, e.g., a device of the type disclosed in commonly owned U.S. Pat. No. 3,730,811 granted to Wendt on May 1, 1973. The leader of a fresh cigarette paper web 302A is held in a position of readiness in the splicing device 299. The web 302A forms a fresh roll 301A on a spindle 298A. The splicing device 299 attaches the leader of the fresh web 302A to the running web 302 and severs the running web 302 behind the splice. The remnant of the roll 301 is thereupon removed and replaced with a fresh roll. The roll 301A is shifted to the position previously occupied by the roll 301 so that it is in the range of the detector 300.

The running web 302 is caused to pass through a conventional imprinting mechanism 297 which provides spaced-apart portions of the web with indicia denoting the brand name of cigarettes, the name and/or trademark of the manufacturer and/or other information. The thus imprinted web 302 thereupon enters a wrapping or draping mechanism 305 which includes an endless conveyor 310 known as garniture. A transfer conveyor 304 serves to deliver into the wrapping mechanism 305 successive increments of a continuous rod-like tobacco filler 303 which is formed in a manner as disclosed in the patent to Reuland. The conveyor 304 includes an endless foraminous belt whose lower reach travels below a suction chamber so that the filler 303 is attracted to the underside of the lower reach and is caused to enter the wrapping station. Successive increments of the oncoming cigarette paper web 302 are draped around successive increments of the filler 303 so that the web 302 is converted into a tube or wrapper of the resulting cigarette rod 307. One marginal portion of the partially draped web 302 is coated with adhesive by a paster 306 and is thereupon caused to overlap and adhere to the other marginal portion. The resulting seam of the wrapper of the rod 307 is heated or cooled by a sealer 308, depending upon whether the adhesive which is applied by the paster 306 is a wet adhesive or a hotmelt. The rod 307 is severed at regular intervals by a cutoff 309 so that it yields a single file of plain cigarettes Z of unit length. The cigarettes Z move axially past a rotary accelerating cam 311 which propels successive cigarettes into successive flutes 312 of a rotary drum-shaped row forming conveyor 313. The latter converts the single file of cigarettes Z into one or more rows wherein the cigarettes move sideways, either to storage, into customary chargers or trays, to a pneumatic sender, to a filter cigarette making machine or directly to a packing machine, not shown. The conveyor 313 corresponds to the conveyor 1 shown in FIG. 1 of the aforementioned commonly owned copending application of Wahle et al.

In accordance with a feature of the invention, the cigarette maker is provided with a testing or monitoring unit 315 which is disposed at a station A located ahead of the imprinting mechanism 297, as considered in the direction of movement of the web 302 from the source of supply 301 toward the garniture 310 of the wrapping mechanism 305. The testing unit 315 includes means for optically scanning successive increments of the running web 302 in order to determine its permeability and for transmitting signals denoting the monitored permeability. The unit 315 comprises a light-emitting diode 314 which consists of gallium arsenide (this diode constitutes the light source) and a photodiode 316 which constitutes a photoelectronic receiver. The web 302 passes between the diodes 314, 316 on its way toward the imprinting mechanism 297. Since the light-emitting and light-sensitive areas of the diodes 314 and 316 are relatively small, the testing unit 315 further comprises two optical systems 317 and 318. The optical system 317 expands the beam of light issuing from the diode 314 so that the beam illuminates the full width of the running web 302, and the optical system 318 focusses light which has passed through the web 302 upon the diode 316.

The means for transmitting voltage pulses (e.g., 5,000 hertz) to the diode 314 comprises a pulse generator 319. The diode 316 transmits signals denoting the light-transmissivity (and hence the permeability) of the wrapper 302 to a peak voltmeter 321 whose output is connected to a signal comparing stage 323 forming part of an evaluating circuit 322. The stage 323 compares the signals from the voltmeter 321 with a reference signal furnished by a suitable source 324 (for example, and adjustable potentiometer). The reference signal denotes the desired permeability of the web 302. If the intensity or another characteristic of the reference signal deviates from the same characteristic of signals which are transmitted by the peak voltmeter 321, the output of the stage 323 transmits a signal to a control circuit 326 for a perforating unit 327.

The perforating unit 327 is installed at a station B ahead of the testing station A, as considered in the direction of travel of the running web 302 from the source of supply 301 to the imprinting mechanism 297. In the illustrated embodiment, the perforating unit 327 is designed to generate sparks which burn holes into the material of the web 302, i.e., the unit removes material from selected portions of the web. This unit comprises two electrodes 328, 329 which are located opposite each other at the opposite sides of the path of movement of the web 302. Each electrode has several projections which may form one or more rows extending longitudinally and/or transversely of the path of movement of the web 302 toward the imprinting mechanism 297. The electrodes 328 and 329 are connected with a source 332 of high potential by an interrupter 331 which is adjustable by a system including the aforementioned control circuit 326 so that the number of holes which are formed per unit area of the running web 302 depends on the intensity of signals furnished by the output of the signal comparing stage 323. The adjusting means further comprises an infinitely variable speed transmission 333 whose ratio can be changed by a servomotor 338 receiving signals from the control circuit 326. The phantom line 334 denotes the operative connection between the prime mover of the cigarette maker and the input element of the transmission 333, and the phantom line 336 denotes the operative connection between the output element of the transmission 333 and the interrupter 331. The prime mover of the cigarette maker further drives at least one of two advancing rolls 337 which draw the web 302 off the roll 301. As shown, the input element of the transmission 333 can receive torque (line 334) from the shaft of the right-hand advancing roll 337.

A somewhat similar perforating unit is shown in FIG. 7 of the aforementioned copending application of Wahle et al.

The operation is as follows:

It is assumed that the prime mover of the cigarette making machine is on so that the rolls 337 draw the web 302 off the roll 301 and the web 302 is draped around the filler 303 during travel through the wrapping mechanism 305. The projections of the electrodes 328, 329 at the station B are connected with the source 332 at a frequency which is determined by the interrupter 331 whereby the resulting sparks burn holes into the web 302 and the permeability of the web increases to the extent determined by the intensity of signal from the control circuit 326 to the servomotor 338, i.e., the permeability is a function of the ratio of the transmission 333.

When the testing unit 315 determines that the permeability of the web 302 is unsatisfactory (either excessive or insufficient), the intensity of signal from the diode 316 to the peak voltmeter 321 changes so that the output of the signal comparing stage 323 transmits a different signal which causes the servomotor 338 to change the speed ratio of the transmission 333 and hence the frequency at which the electrodes 328, 329 are connected with the source 332 of high potential.

Since the diode 314 is operated in pulsating fashion, the amplitude of pulses transmitted by the generator 319 can be higher than during continuous operation of the diode 314. The peak voltmeter 321 detects the amplitude of signals which are transmitted by the diode 316 and furnishes a continuous signal whose intensity or another characteristic is indicative of monitored permeability of the web 302 between the optical systems 317 and 318.

As a rule, the permeability of the web 302 changes only gradually, i.e., the rate at which the speed ratio of the transmission 333 is changed by the motor 338 is also gradual. Whenever the speed ratio of the transmission 333 is changed in response to signals from the testing unit 315, the perforating unit 327 changes the number of holes per unit area of the web 302 and hence the permeability of the wrapping material.

It is clear that the perforating unit 327 constitutes but one of several types of means which can be used to change the permeability of a running web of cigarette paper or the like. For example, one can use mechanical perforating units or one or more lasers of the type disclosed in the copending application of Wahle et al. It is immaterial whether a change involves varying the size of holes or the number of holes per unit area. All that counts is to insure that the perforating unit can change the permeability of successive increments (unit areas) of the web 302 in response to signals from a suitable testing unit, i.e., whenever the testing unit (in combination with the evaluating means 322) ascertains that the monitored permeability is unsatisfactory.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A method of regulating the permeability of a running web of wrapping material which is converted into tubular wrappers surrounding the fillers of rod-shaped articles constituting or forming part of smokers' products, comprising the steps of advancing the web and the fillers to a wrapping station; draping the running web around the fillers at said station; making holes in the material of the running web; monitoring the permeability of the running web ahead of said station; comparing the monitored permeability with a predetermined value denoting the desired permeability of the web; and changing the combined cross-sectional area of holes per unit area of the material of the running web when the monitored permeability deviates from said predetermined value.

2. A method as defined in claim 1, wherein said step of making holes precedes said monitoring step.

3. A method as defined in claim 1, wherein said step of making holes includes removing portions of the material of said web.

4. A method as defined in claim 1, wherein said monitoring step comprises directing a beam of light against one side of the web and measuring the quantity of light which passes through successive increments of the web, such quantity being indicative of permeability of the respective increments.

5. A method as defined in claim 1, wherein said fillers together constitute a continuous rod-like filler and the material of said web is at least slightly porous prior to said hole making step.

6. In a machine for converting a running web of wrapping material into tubular wrappers surrounding the fillers of rod-shaped articles which constitute or form part of smokers' products, the combination of a source of wrapping material; means for draping the web around said fillers; means for advancing the web from said source to said draping means; adjustable perforating means including means for making holes in the material of said running web; means for monitoring the permeability of the running web intermediate said source and said draping means; signal generating means for comparing the results of monitoring with a predetermined value denoting the desired permeability of the running web; and means for adjusting said perforating means in response to signals furnished by said comparing means when the monitored permeability deviates from said predetermined value.

7. The combination of claim 6, wherein said perforating means is disposed intermediate said monitoring means and said source.

8. The combination of claim 6, wherein said perforating means includes means for removing portions of the material of said web.

9. The combination of claim 6, wherein said monitoring means includes means for directing a beam of light against one side of the web and means for transmitting to said comparing means signals denoting the quantity of light passing through successive increments of the web.

10. The combination of claim 6, further comprising a source of reference signals representing said predetermined value, said last mentioned source having an output connected with said comparing means.

11. A Method of regulating the permeability of a running web of wrapping material which is converted into tubular wrappers surrounding the fillers of rod-shaped articles constituting or forming part of smokers' products, comprising the steps of advancing the web and the fillers to a wrapping station; draping the running web around the fillers at said station; making holes in the material of the running web by generating sparks which burn holes in said web; continuously monitoring the permeability of the running web ahead of said station; continuously comparing the monitored permeability with a predetermined value denoting the desired permeability of the web; and changing the combined cross-sectional area of holes per unit area of the material of the running web when the continuously monitored permeability deviates from said predetermined value.

12. A method of regulating the permeability of a running web of wrapping material which is converted into tubular wrappers surrounding the fillers of rod-shaped articles constituting or forming part of smokers' products, comprising the steps of advancing the web and the fillers to a wrapping station; draping the running web around the fillers at said station; making holes in the material of the running web by generating sparks which burn holes in said web; continuously monitoring the permeability of the running web ahead of said station by optically scanning successive increments of the web; continuously comparing the monitored permeability with a predetermined value denoting the desired permeability of the web; and changing the combined cross-sectional area of holes per unit area of the material of the running web when the continuously monitored permeability deviates from said predetermined value.

13. A method of regulating the permeability of a running web of wrapping material which is converted into tubular wrappers surrounding the fillers of rod-shaped articles constituting or forming part of smokers' products, comprising the steps of advancing the web and the fillers to a wrapping station; draping the running web around the fillers at said station; making holes in the material of the running web by generating sparks which burn holes in said web; continously monitoring the permeability of the running web ahead of said station by optically scanning successive increments of the web by emitting a beam of light from a light emitting diode, said beam first being optically expanded to illuminate the full width of said web and then, after passing through the web, being focused upon a photo diode; continuously comparing the monitored permeability with a predetermined value denoting the desired permeability of the web; and changing the combined cross-sectional areas of holes per unit area of holes per unit area of the material of the running web when the continuously monitored permeability deviates from said predetermined value.

14. A method of regulating the permeability of a running web of wrapping material which is coverted into tubular wrappers surrounding the fillers of rod-shaped articles constituting or forming part of smokers' products, comprising the steps of advancing the web and the fillers to a wrapping station; draping the running web around the fillers at said station; making holes in the material of the running web by generating sparks which burn holes in said web; continuously monitoring the permeability of the running web ahead of said station by optically scanning successive increments of the web by emitting a beam of light from a light emitting diode; continuously comparing the monitored permeability with a predetermined value denoting the desired permeability of the web; and changing the combined cross-sectional area of holes per unit area of the material of the running web by altering the rate at which said holes are burned in said web when the continuously monitored permeability deviates from said predetermined value.

15. A method of regulating the permeability of a running web of wrapping material which is converted into tubular wrappers surrounding the fillers of rod-shaped articles constituting or forming part of smokers' products, comprising the steps of advancing the web and the fillers to a wrapping station; draping the running web around the fillers at said station; making holes in the material of the running web by generating sparks which burn holes in said web; continuously monitoring the permeability of the running web ahead of said station by opitcally scanning successive increments of the web by emitting a beam of light from a light emitting diode, said beam first being optically expanded to illumiante the full width of said web and, then, after passing through the web, being focussed upon a photo diode; continuously comparing the monitored permeability with a predetermined value denoting the desired permeability of the web; and changing the combined cross-sectional area of holes per unit area of the material of the running web by altering the rate at which said holes are burned in said web when the continuously monitored permeability deviates from said predetermiend value.

* * * * *